US009517908B2

(12) United States Patent
Meier

(10) Patent No.: US 9,517,908 B2
(45) Date of Patent: Dec. 13, 2016

(54) SPINDLE AND DISPENSER FOR ROLL PRODUCTS AND METHODS FOR MAKING AND USING SAME

(71) Applicant: 3M INNOVATIVE PROPERTIES COMPANY, St. Paul, MN (US)

(72) Inventor: Thomas C. Meier, Woodbury, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 122 days.

(21) Appl. No.: 14/363,246

(22) PCT Filed: Dec. 14, 2012

(86) PCT No.: PCT/US2012/069694

§ 371 (c)(1),
(2) Date: Jun. 5, 2014

(87) PCT Pub. No.: WO2013/090687

PCT Pub. Date: Jun. 20, 2013

(65) Prior Publication Data

US 2014/0332617 A1 Nov. 13, 2014

Related U.S. Application Data

(60) Provisional application No. 61/576,809, filed on Dec. 16, 2011.

(51) Int. Cl.
*B65H 16/02* (2006.01)
*B65H 35/00* (2006.01)

(52) U.S. Cl.
CPC ..... *B65H 16/02* (2013.01); *B65H 35/002* (2013.01); *Y10T 29/49826* (2015.01)

(58) Field of Classification Search
CPC ..... B65H 16/005; B65H 2402/443
See application file for complete search history.

(56) References Cited

U.S. PATENT DOCUMENTS

| | | | |
|---|---|---|---|
| 634,589 | A | 10/1899 | Russell |
| 2,177,627 | A | 2/1938 | Gurley |
| 2,350,369 | A | 6/1944 | Sampair |
| 2,352,445 | A | 6/1944 | Pinckney |
| 2,370,821 | A | 3/1945 | Stott |
| 2,424,486 | A | 7/1947 | Miller |
| 2,772,774 | A | 12/1956 | Rabuse |

(Continued)

FOREIGN PATENT DOCUMENTS

| | | |
|---|---|---|
| CN | 101249904 A | 12/2012 |
| JP | 02108938 | 4/1990 |

OTHER PUBLICATIONS

International Search Report for PCT International Application No. PCT/US2012/069694 mailed on Mar. 14, 2013, 4 pages.

*Primary Examiner* — Sang Kim
(74) *Attorney, Agent, or Firm* — Robert H. Jordan

(57) ABSTRACT

Spindles (10) adapted to receive a tape roll having a core opening thereof and comprising an elongate body (12) and at least one spacing member (14*a*, 14*b*, 14*c*) comprising a protuberance (18*a*, 18*b*, 18*c*) wherein the protuberance is configured such that it can be configured in a first protruding position and in a second non-protruding position. Also, dispensers comprising such spindles, methods of assembling such dispensers, and methods of dispensing tape from tape rolls mounted on such spindle.

20 Claims, 3 Drawing Sheets

(56) References Cited

U.S. PATENT DOCUMENTS

| | | | | |
|---|---|---|---|---|
| 3,635,383 | A * | 1/1972 | Waltz | B65H 35/002 206/408 |
| 3,768,713 | A | 10/1973 | Lash | |
| 4,625,901 | A | 12/1986 | Adelizi | |
| 5,135,179 | A | 8/1992 | Morano | |
| 5,374,008 | A | 12/1994 | Halvorson | |
| 5,624,025 | A | 4/1997 | Hixon | |
| D399,257 | S | 10/1998 | Tang | |
| 6,199,791 | B1 | 3/2001 | Conran | |
| D448,415 | S | 9/2001 | Huang | |
| D470,181 | S | 2/2003 | Jour | |
| D470,815 | S | 2/2003 | Gates et al. | |
| 6,729,512 | B1 * | 5/2004 | Leighton | B65H 35/002 224/269 |
| D504,155 | S | 4/2005 | Crawford | |
| 6,913,178 | B2 | 7/2005 | Huang | |
| 6,974,060 | B2 | 12/2005 | Gomes | |
| D524,376 | S | 7/2006 | Flynn | |
| 7,290,733 | B2 | 11/2007 | Kamenstein | |
| 7,828,152 | B2 | 11/2010 | Hamanaka et al. | |
| 2006/0151660 | A1 * | 7/2006 | Stringer | B65D 85/672 242/588.3 |

* cited by examiner

SPINDLE AND DISPENSER FOR ROLL PRODUCTS AND METHODS FOR MAKING AND USING SAME

FIELD

The present invention relates to spindles and dispensers for roll products.

BACKGROUND

Tape products (e.g., paper, decorative ribbons, adhesive tape for office use, medical use, etc.), some adhesive backed, some not, are commonly supplied in roll form and then dispensed by unwinding from the roll. In many dispenser configurations, the roll, which in some instances comprises an anular core and in other instances is coreless, is mounted on a spindle about which the roll turns as tape is removed therefrom. In many dispensers, the dispenser is configured to support the spindle and roll mounted thereon in desired position and orientation for dispensing, e g , easy finger access to the end of the tape to permit gripping, convenient proximity to a cutting blade to permit easy separation of a desired portion of the tape from the rolled portion, etc.

While some dispenser configurations are configured for single rolls of tape, others are configured for two or more rolls. Illustrative examples include U.S. Pat. No. 2,424,486 (Miller), U.S. Pat. No. 3,768,713 (Lash), and D470,181 (Jour). If the plurality of rolls of tape is intended to dispense independently, interference between adjacent rolls must be prevented such that tape from a single roll may be dispensed without simultaneously causing tape to undesirably come off an adjacent roll. If adjacent rolls are not spaced apart, as sheet material is dispensed from a first roll that roll may drag against an adjacent roll causing quantities of tape to be removed undesirably from the adjacent roll. Illustrative measures taken to achieve this include: using independent spindles for each roll, as disclosed in, e.g., U.S. Pat. No. 2,352,445 (Pinckney), D448,415 (Huang), D504,15 (Crawford et al.), and D524,376 (Flynn); placing spacer disks between adjacent rolls on a single spindle, as disclosed in, e.g., U.S. Pat. No. 634,589 (Russell), U.S. Pat. No. 6,913,178 (Huang), and U.S. Pat. No. 6,974,060 (Gomes et al.); or providing a protruding element such as a radial boss on the spindle to act as a divider, as disclosed in, e.g., U.S. Pat. No. 6,119,791 (Conran et al.). While the apparatuses disclosed to date may offer acceptable performance in some aspects, none provides the desired range of performance, ease of use, and low cost.

The need exists for improved spindles and dispensers for tape products.

SUMMARY

The present invention provides improved spindles for tape products in roll form having a core opening therein, improved dispensers incorporating such spindles, and associated methods of assembly and use thereof.

In brief summary, a spindle of the invention comprises an elongate body and at least one spacing member, optionally comprising a protuberance, wherein the spacing member is adapted to be configured to be moved between a first protruding position and a second non-protruding position. Spindles of the invention are adapted to receive a tape roll having a core opening.

Briefly summarizing, a dispenser of the invention comprises a spindle of the invention and, optionally, one or more tape rolls mounted thereon. The dispenser is adapted such that at least one end of the spindle can be free to so as to permit a tape roll having a core opening to be mounted thereon and removed therefrom.

In brief summary, the methods of the invention are:

(a) a method for assembling a dispenser as described herein comprising sliding a tape roll having a core opening over an end of spindle as described herein wherein the tape roll slides at least one of: (i) over a spacing member or (ii) to a spacing member; and (b) dispensing tape from a tape roll having a core opening wherein the tape roll is mounted on a spindle as described herein and rotates about the spindle as the tape is dispensed .

Spindles of the invention and dispensers incorporating them provide numerous advantages as discussed below. In accordance with the invention, such spindles can enable convenient, effective operation of dispensers with one or a plurality of tape rolls. Spindles of the invention can be used to achieve easy reloading of tape rolls as well as facile alteration of the number and widths of tape rolls on a dispenser.

BRIEF DESCRIPTION OF DRAWING

The invention is further explained with reference to the drawing wherein like reference numerals are used throughout and wherein.

These figures are not to scale and are intended to be merely illustrative and not limiting.

DETAILED DESCRIPTION OF ILLUSTRATIVE EMBODIMENTS

Figure 1:
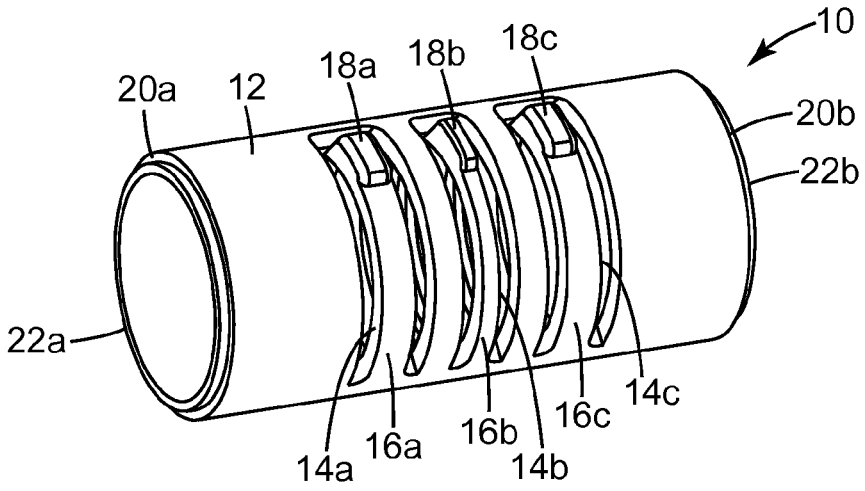
FIG. 1 is a perspective view of a first illustrative embodiment of a spindle of the invention.

FIG. 1 shows an illustrative spindle 10 of the invention. Spindle 10 comprises body 12 and spacing members 14*a*, 14*b*, and 14*c*. The spacing members comprise arms 16*a*, 16*b*, and 16*c*, respectively, and protuberance 18*a*, 18*b*, and 18*c*, respectively. Spindles of the invention may comprise one or more spacing members as desired.

The body is elongate, having a longitudinal axis.

Spacing members may be located at equivalent positions on the longitudinal axis of the spindle, i.e., at substantially even distance from a common end thereof, to function simultaneously with the same tape roll(s). Spacing members may be located at different locations on the longitudinal axis of the spindle, i.e., at substantially different distances from a common end thereof, to function in accordance with the invention with tape rolls having different widths as desired.

Figure 2A:
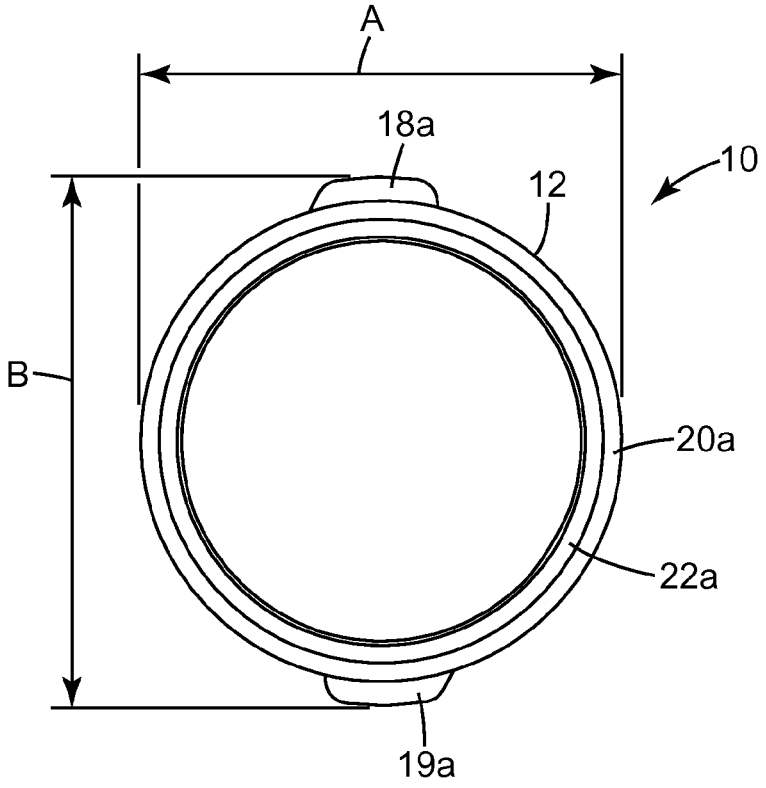
FIG. 2*a* is an end view of the spindle shown in FIG. 1.
Figure 2B:
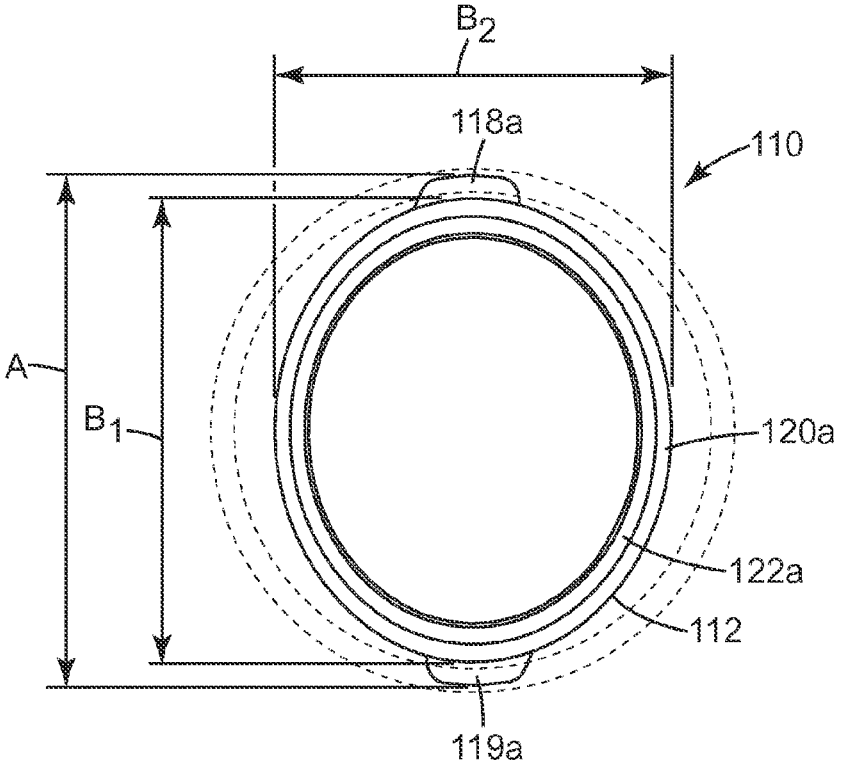
FIG. 2*b* is an end view of a second illustrative embodiment of a spindle of the invention.

In the embodiment shown in FIG. 1, the body is generally cylindrical, i.e., elongate with a cross section perpendicular to the longitudinal axis which is generally circular with the exception of the protruding spacing members as shown in FIG. 2*a*. As will be understood, spindles having other geometries may be used in accordance with the invention, e.g., a generally oval cross section as shown in FIG. 2*b*.

The spacing members can be configured in first, protruding position and a second, non-protruding position. FIG. 1 illustrates a preferred embodiment wherein the spacing members are in the form of resilient arms having a protruding portion thereon.

Referring to FIGS. 1 and 2*a*, body 12 is generally cylindrical having diameter of dimension A. In their first or protruding configuration, protuberances 18*a* and 19*a* protrude beyond the surface of body 12 to define dimension B. When protuberances 18*a* and 19*a* and the other portions of the respective spacing members are configured in their respective second or non-protruding positions they will be withdrawn into the interior of body 12 such that they do not substantially protrude beyond the cross sectional profile of body 12 (i.e., dimension A). In some instances, they may be recessed below the cross sectional profile of body 12.

Figure 3:
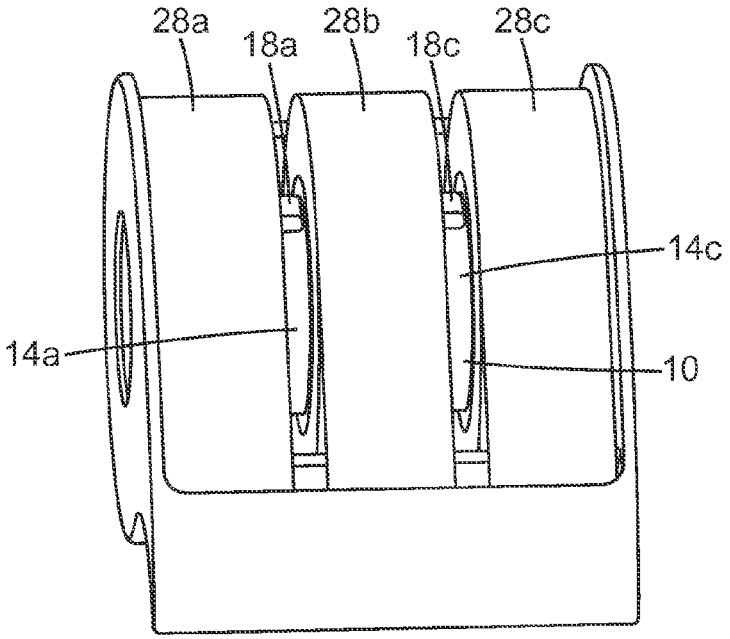
FIG. 3 is a perspective view of an illustrative embodiment of a dispenser of the invention with the spindle from FIGS. 1 and 2*a* with three tape rolls thereon.
Figure 4:
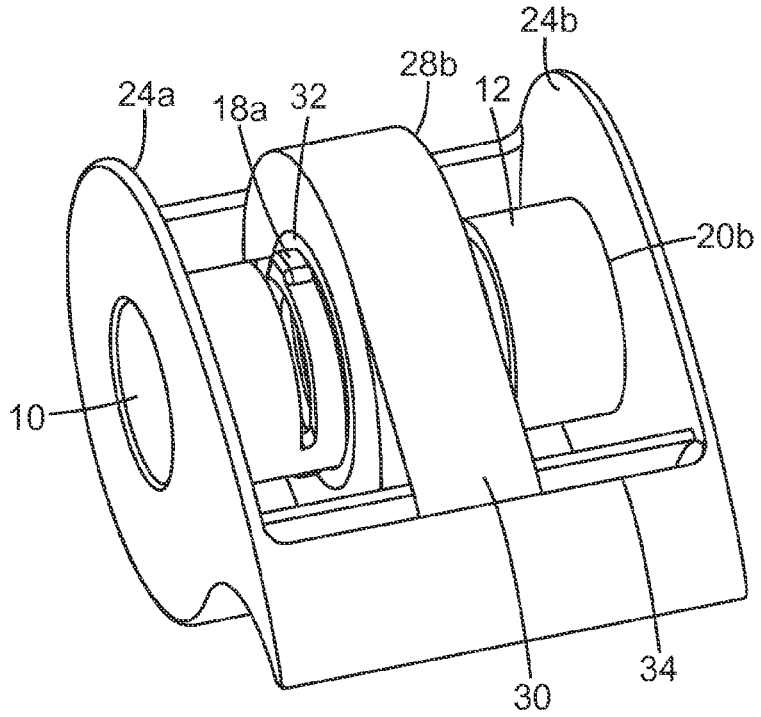
FIG. 4 is a perspective view of the dispenser of FIG. 3 with a single tape roll thereon.
Figure 5:
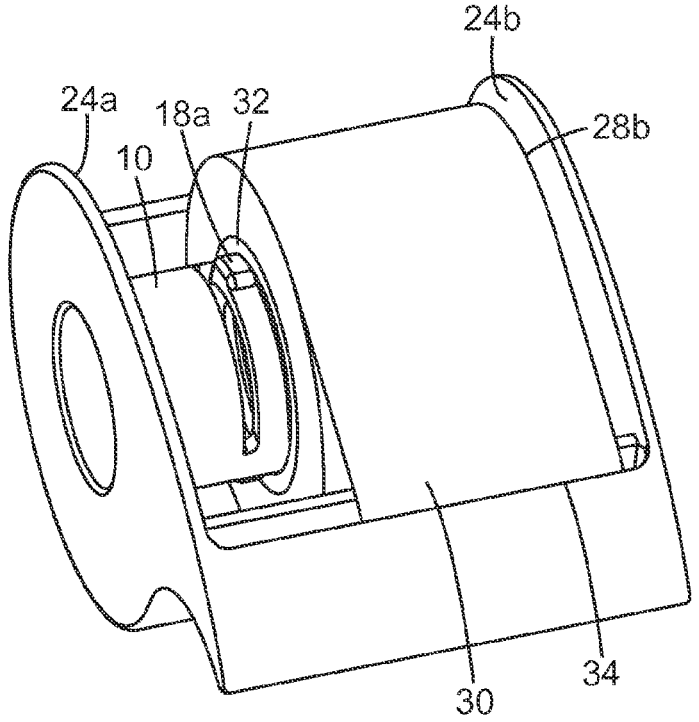
FIG. 5 is a perspective view of the dispenser of FIG. 3 with a single tape roll thereon.

Tape rolls typically have circular annular core openings, with or without cores. Spindles can be used in accordance with the invention with tapes rolls having core openings having inner diameters that are: (1) at least as large as the largest dimension (dimension A in FIG. 1), in the direction perpendicular to its longitudinal axis, of the body of the spindle with spacing members in their non-protruding position, and (2) no larger than the largest dimension (dimension B in FIG. 1), in the direction perpendicular to its longitudinal axis, of the body of the spindle with spacing members in their protruding position. Dimension A of the spindle 10 is the minimum, and dimension B is the maximum, core diameter of tape rolls that could be used thereon in accordance with the invention. In such relationship, as shown in FIGS. 3 and 4, tape roll 28*b* is retained in desired longitudinal position on the spindle and as can be seen in FIG. 3, adjacent rolls do not contact. Thus, in accordance with the invention, material may be dispensed from any of the tape rolls without interference from adjacent tape rolls.

FIG. 2*b* shows an illustrative alternative embodiment wherein body 112 of spindle 110 has an oval cross section, i.e., dimension $B_1$ is less than $B_2$. Protuberances 118*a* and 119*a* of the spacing members can be configured protruding positions such that they extend beyond the long dimension of body 112, shown as dimension A. Such spindles can be used in accordance with the invention with tape rolls having core openings (e.g., tape core shown here in dotted line) that have a diameter of at least dimension $B_1$ but less than dimension A. Spindle 110 is adapted, e.g., with protruding neck 122*a* on end 120*a*, to engage with a dispenser (not shown).

In the embodiment shown in FIG. 1, spacing member 14*a* is integral with body 12, as are spacing members 14*b* and 14*c*. In addition to protuberance 18*a*, spacing member 14*a* comprises arm 16*a* which is connected to body 12. To move or reconfigure protuberance 18*a* from the protruding position shown to a non protruding position, arm 16*a* is flexed. Arm 16*a* is preferably made of a resilient material such that protuberance 18*a* can be repeatedly moved from a protruding position to a non-protruding position and vice versa as desired. Configuration of the spacing member into its non-protruding position can be achieved by application pressure so urging the spacing member, e.g., application of force directly to the spacing member such as by hand or finger. In some embodiments, protruding portions of the spacing member may be adapted such that a lateral force applied by moving a tape roll having a core opening onto the spindle will, when forced against the side of the spacing member cause it to recede into the body and adopt the non-protruding configuration. For instance, in the preferred embodiment shown in FIG. 1, the protuberances have tapered surfaces such that they will more change configuration from a protruding position to a non-protruding position. In such instances, the materials and component configurations are preferably such that the magnitude of minimum lateral force necessary to cause the spacing member(s) to move into their non-protruding position is greater than the magnitude of lateral force created as tape is dispensed. If the magnitude of lateral force created as tape is dispensed is too high, then during use as tape is dispensed the desired stability of the tape roll and lack of interference with adjacent tape roll(s) on the spindle will be lost.

Preferably spacing member 14*a* comprises a resilient material such that when no countervailing force is applied or when such a force is removed the protuberance 18*a* is urged into its protruding position. For instance, such a spindle can be formed by molding resilient plastic in a form with the spacing member(s) thereon configured in their protruding configuration. To configure the spacing members in their non-protruding configuration pressure is applied to the spacing member. Upon release of the pressure, the spacing member will recover, thereby configuring the spacing member in its protruding position.

In preferred embodiments, spindle 10 is fabricated from a resilient, durable plastic. Illustrative examples include, e.g., polystyrene and acrylonitrile butadiene styrene polymers, such that spacing member 14*a* can be flexed reconfiguring protuberance 18*a* in a protruding position and in a non-protruding position repeatedly as well as withstand thousands of turns of the roll tape about the spindle, installation and removal of tape rolls having core openings thereon, and assembly and disassembly of the dispenser, if any, of which they are a part.

In some embodiments (not shown), the spacing member may be mounted on a spring configured to urge it into a protruding position but permitting it to be depressed into a non-protruding position to permit installation, removal, and repositioning of tape rolls on the spindle.

At least one end, and in some embodiments both ends, of the spindle are configured to engage with a support. For instance, as shown in FIG. 1, ends 20*a* and 20*b* of spindle 10 each have a protruding neck, 22*a* and 22*b*, respectively. As shown in FIG. 4, ends 20*a* and 20*b* engage with walls 24*a* and 24*b*, respectively, of dispenser 26. Walls 24*a* and 24*b* are each configured to receive and support ends 20*a* and 20*b*, respectively. In some embodiments, for instance, walls 24*a* and 24*b* each has a recess of suitable size to receive protruding necks 22 and 22*b*, respectively so as to securely, preferably releasably, support spindle 10. Other embodiments in which spindle 10 can be releasably mounted to a support in a dispenser will be readily apparent to those skilled in the art. Illustrative examples including U-shape yokes, protrusions from the support walls that engage with the spindle, e.g., posts that protrude into a hollow end, etc. The spindle and dispenser mount should be strong and durable enough to support the intended number of rolls, as well as withstand manipulation during dispensing of tape, and during removal of tape rolls and installation of fresh or different tape rolls.

In some embodiments, spindles of the invention will comprise a single spacing member. In other embodiments, the spindle will comprise two or more spacing members located at different longitudinal locations along the longitudinal axis of the spindle and can be used with a single roll or two or more rolls with one or more spacing members between adjacent tape rolls. For example, in FIG. 1, spacing members 14*a*, 14*b*, and 14*c* are located at progressively greater distance from end 20*a*.

In preferred embodiments, the spindle comprises a second spacing member located at the same, i.e., equivalent, longitudinal location as a first spacing member, preferably directly perpendicularly across the longitudinal axis of the spindle from the first spacing member. Such an embodiment is shown in FIG. 2 where protuberance 18*a* on spacing member 14*a* is located substantially perpendicularly across body 12 from protuberance 19*a* on another similar spacing member (not visible in this view).

FIG. 3 shows dispenser 26 comprising spindle 10 on which tape rolls 28*a*, 28*b*, and 28*c* are mounted. As can be seen in FIG. 3, tape roll 28*b* comprises sheet 30 of a material wound into roll form on optional core 32, core 32 having an opening in the center thereof. Such tape roll configurations are conventional in the art. In some embodiments, sheet material may be wound into roll form, e.g., about a mandrel, without a core.

Turning again to FIG. 3, adjacent tape rolls are separated by at least one spacing member. For instance, tape rolls 28*a* and 28*b* are separated by protrusion 18*a* on spacing member 14*a* and protrusion 19*a* of the spacing member (not visible in this perspective) on the opposite side of spindle 10. Similarly, tape rolls 28*b* and 28*c* are separated by protrusion 18*c* on spacing member 14*c*. In this configuration, protrusions 18*a* and 18*c* are each in a protruding position, i.e., they extend radially from the surface of body 12 of spindle 10 so as to maintain desired separation of the tape rolls. In this configuration, protrusion 18*b* (not visible) is in a non-protruding position underneath core 32 of tape roll 28*b*.

If desired, rolls 28*b* and 28*c* could be removed and a single roll mounted on the spindle, e.g., using spacing member 14*a* to maintain its separation from roll 28*a* or, if the dimensions of the roll permit, using spacing member 14*b* to do so. When installing a tape roll on the spindle, the spindle is inserted into the opening of the roll or alternatively the roll placed over the spindle, such that the roll and spindle travel with respect to one another in a direction parallel to the longitudinal axis of the spindle. To facilitate this process, the edges of the protrusions are preferably tapered somewhat as shown in FIGS. 1 and 2 such that the spacing member will flex into the spindle body permitting the tape roll to be moved past.

Tape dispenser 26 also comprises cutting member 34, e.g., a straight edge, which can be used to facilitate separation of a desired quantity of sheet material from any of the tapes as desired.

In preferred embodiments, a first tape roll will be held in position on the spindle by at least one spacing member such that the tape roll will not slide longitudinally on the spindle into interfering contact with an adjacent second tape roll as sheet material is dispensed from the first tape roll. In FIG. 3, tape roll 28*b* is held in longitudinal position by two spacing members, i.e., spacing member 14*a* and 14*c*. The enhanced stability this provides improves the ease with which sheet material 30 can be removed from tape roll 28*b* and cleanly separated by cutting member 34 without entanglement with or partial unrolling of adjacent rolls 28*a*, 28*c*. Accordingly, the longitudinal position of spacing members on the body will be selected in part based upon the width dimensions of tape rolls with which the spindle, or dispenser incorporating same, is used.

In accordance with the invention, a tape roll and spindle are selected such that the effective outer diameter of the body of the spindle is smaller than the inner diameter of the opening in the tape roll such that the spindle can receive the tape roll thereon. It is typically preferred that the tape roll can roll freely about the spindle, e.g., under simply the rotational impetus imparted by pulling the end of the sheet material from the tape roll, with no or only minimal drag. Often, a little bit of drag is desired such that the roll will stop turning as the dispensing action is halted. On the other hand, if excessive drag occurs, it is more difficult to dispense sheet material as desired and the sheet material may be degraded, e.g., torn, stretched undesirably, etc. In some embodiments the inner diameter of the tape roll is only slightly larger than the outer diameter of the spindle such that the tape roll will spin freely about the spindle without wobbling, etc. As will be understood by those skilled in the art, desired frictional relation of the spindle and tape rolls can be achieved by selecting compatible materials that exhibit the desired properties or treating components, e.g., by application of an appropriate friction-adjusting coating.

The present invention may be used with tape rolls of a wide variety of sheet materials. Sheet materials may be adhesive or not, may be substantially continuous or have openings therein, may be smooth or have structured surfaces thereon, etc. Illustrative examples include paper, plastic, and metal films, webs, sheets, etc.

One of the advantages of the present invention is that a single spindle apparatus equipped with at least one, and preferably two or more, spacing members at different longitudinal positions on the spindle, or a dispenser comprising such a spindle can be advantageously used with a variety of different tape rolls of different widths. Different width tape rolls can be changed in and out frequently and easily using the same spindle. For instance, the embodiment shown in FIG. 3, if body 12 is 2 1/16 inches long, with protrusions 18*a* and 18*c* are spaced about 5/8 inch from ends 20*a* and 20*b*, respectively, protrusions 18*a* and 18*c* spaced about 5/8 inch apart from each other, and protrusion 18*b* spaced about 1 inch from both ends 20*a* and 20*b*, can be used to effectively with, for example, one, two, or three 1/2 inch tape rolls; one or two 1 inch rolls; one 2 inch roll; or one 1/2 inch roll with one 1 inch roll.

The invention provides a method for assembling a tape dispenser comprising sliding a tape roll having a circular core opening over an end of the spindle and at least one of: (i) over a first spacing member or (ii) to a first spacing member that is in its protruding position. In accordance with the invention, in some embodiments the method comprises sliding the first tape roll over or beyond a first spacing member and further comprises sliding a second tape roll having a circular core opening over the spindle to the first spacing member wherein said tape rolls are separated by at least the first spacing member that is in its protruding position.

The invention provides a method for dispensing tape from a tape roll having a core opening wherein the tape roll is mounted on a spindle as described herein and rotates about the spindle as the tape is dispensed, e.g., by pulling the end of the tape to unwind a portion of tape from the tape roll and then typically separating a portion of the tape by severing it from the roll portion, e.g., by cutting such as by pulling it across a cutting member on a dispenser. In some embodiments, the spindle will have first and second tape rolls mounted thereon, the tape rolls being separated by a first spacing member that is in its protruding position such that when said first tape roll rotates about said spindle, e.g., as tape is dispensed therefrom, it substantially does not contact said second tape roll.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom. The complete disclosure of all patents, patent documents, and publications cited herein are incorporated by reference.

What is claimed is:

1. A spindle adapted to receive a tape roll having a core opening which has an inner diameter, wherein said spindle comprises an elongate body having a longitudinal axis and defining a cross sectional profile perpendicular to said longitudinal axis, the cross sectional profile of the elongate body being smaller than the inner diameter of the core opening, and wherein the at least one spacing member can be configured in a first position extending from the body perpendicular to the longitudinal axis to define a dimension which is larger than the cross sectional profile of the elongate body and in a second position defining a dimension perpendicular to the longitudinal axis which is less than the dimension defined in the first configuration and which is small enough to permit the tape roll to be positioned thereover while the tape roll is received on the spindle.

2. The spindle of claim 1 wherein said body is generally cylindrical.

3. The spindle of claim 1 wherein said body has a cross section that is not circular.

4. The spindle of claim 1 wherein said spacing member and said body are integral.

5. The spindle of claim 1 wherein spacing member comprises a protuberance that can be configured in a first protruding position and in a second non-protruding position.

6. The spindle of claim 5 wherein said spacing member comprises an arm connecting said protuberance to said body.

7. The spindle of claim 6 wherein said arm is resilient and urges said protuberance into said first position.

8. The spindle of claim 1 comprising a spring configured to urge said spacing member into said first position.

9. The spindle of claim 1 wherein said spindle comprises two or more spacing members which can be independently configured in a first position and in a second position and which are located at different longitudinal locations.

10. The spindle of claim 1 wherein said spindle comprises two or more spacing members which can be independently configured in a first position and a second position and which are located at equivalent longitudinal locations.

11. The spindle of claim 1 wherein at least one end is configured to engage with a support.

12. The spindle of claim 11 wherein two ends are configured to engage with a support.

13. A tape dispenser comprising a spindle of claim 11, the dispenser adapted such that at least one end of the spindle can be free to permit a tape roll having a core opening to be mounted thereon and removed therefrom.

14. The tape dispenser of claim 13 further comprising two tape rolls mounted on said spindle wherein said tape rolls are separated by at least one said spacing member which can be configured in a first position and in a second position and which is in a first position.

15. The dispenser of claim 13 wherein said spindle is releasably mounted thereon, the dispenser and spindle being adapted to permit removal and replacement of tape rolls thereon.

16. The dispenser of claim 13 further comprising a cutting member.

17. A method for assembling a dispenser of claim 13 comprising sliding a first tape roll having a core opening over an end of the spindle and at least one of:

(i) over a first spacing member that is in its second position; or (ii) to a first spacing member that is in its first position.

18. The method of claim 17 comprising sliding the first tape roll over the first spacing member and further comprising sliding a second tape roll having a core opening over the spindle to a first spacing member wherein said tape rolls are separated by at least the first spacing member that is in its first position.

19. A method for dispensing tape from a dispenser of claim 13 having a first tape roll thereon comprising removing a portion of tape from said first tape roll such that said first tape roll rotates about said spindle.

20. The method of claim 19 wherein said dispenser has a second tape roll thereon, the first and second tape rolls being separated by a first spacing member that is in its first position such that when said first tape roll rotates about said spindle it substantially does not contact said second tape roll.

* * * * *